US006376436B1

(12) United States Patent
Cronce

(10) Patent No.: US 6,376,436 B1
(45) Date of Patent: Apr. 23, 2002

(54) CHEMICAL WARFARE AGENT DECONTAMINATION FOAMING COMPOSITION AND METHOD

(75) Inventor: Donald T. Cronce, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/533,954

(22) Filed: Mar. 22, 2000

(51) Int. Cl.[7] ..... C11D 1/62; C11D 3/395

(52) U.S. Cl. ..... 510/110; 510/123; 510/131; 510/382; 510/384; 510/391; 510/504; 510/302; 510/309; 510/310; 510/367

(58) Field of Search ..... 510/110, 123, 510/131, 382, 384, 391, 504, 302, 309, 310, 367

(56) References Cited

U.S. PATENT DOCUMENTS

| | | | | | |
|---|---|---|---|---|---|
| 2,759,975 | A | | 8/1956 | Chiddix et al. | 260/567.6 |
| 2,916,855 | A | | 12/1959 | Thiegs | 47/58 |
| 3,024,283 | A | | 3/1962 | Metcalfe et al. | 260/567.6 |
| 3,852,210 | A | * | 12/1974 | Krezanoski | 252/95 |
| 4,165,375 | A | | 8/1979 | Berger et al. | 424/263 |
| 4,203,850 | A | | 5/1980 | Wirtz et al. | 252/8.05 |
| 4,409,908 | A | | 10/1983 | Udyma et al. | 110/346 |
| 5,069,797 | A | | 12/1991 | Bartram et al. | 210/690 |
| 5,075,297 | A | | 12/1991 | Bannard et al. | 514/183 |
| 5,077,316 | A | | 12/1991 | Bannard et al. | 514/731 |
| 5,612,300 | A | | 3/1997 | von Blucher et al. | 510/110 |
| 5,670,469 | A | | 9/1997 | Dingus et al. | 510/274 |
| 5,753,138 | A | * | 5/1998 | Watson et al. | 252/186.1 |
| 5,760,089 | A | | 6/1998 | Cronce | 514/643 |
| 5,859,064 | A | * | 1/1999 | Cronce | 514/643 |
| 5,864,767 | A | | 1/1999 | Drumgoole et al. | 588/202 |
| RE37,207 | E | | 6/2001 | Cronce | 514/643 |

* cited by examiner

*Primary Examiner*—Charles Boyer
(74) *Attorney, Agent, or Firm*—James B. Bechtel, Esq.; James C. Lydon, Esq.

(57) ABSTRACT

A foaming decontaminating composition useful for chemical and biological warfare applications. The foaming decontaminating composition has a quaternary ammonium complex component, a corrosion inhibitor, an oxidizer component and a foam component, with an adjusted pH of at least 8.

18 Claims, No Drawings

CHEMICAL WARFARE AGENT DECONTAMINATION FOAMING COMPOSITION AND METHOD

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to foaming chemical warfare agent decontamination compositions. More particularly, the foaming decontamination compositions include a foaming component with a quaternary ammonium complex (QAC) and oxidizer for effecting large area cleanup of chemical and biological warfare agents. The foaming decontamination compositions allows a uniform application of the decontamination composition against warfare agents. The foaming compositions are useful in neutralizing chemical and biological warfare agents over large surfaces or areas.

2. Brief Description of the Related Art

Neutralization of chemical and biological warfare agents on a large scale, i.e., across large areas or on major pieces of equipment is particularly difficult to achieve. Application of large amounts of decontamination composition does not solve a large scale contamination problem. With the large scale dispersion of the decontamination composition, effective contact between the decontamination composition and warfare agents decreases. Spreading a large amount of decontamination composition in an area allows the decontamination composition to absorb into ground, or seep away on equipment, without neutralization of the warfare agent. Saturation of the area with decontamination composition does not ensure reaction with the warfare agent, that may require mechanical agitation to effectuate the decontamination composition with the warfare agent. Scrubbing by personnel, to provide mechanical agitation, once the decontamination composition has been applied may expose the personnel to both the decontamination composition and the warfare agent, presenting a serious safety hazard. Additionally, the decontamination composition may prove hazardous to personnel and equipment, regardless of the amount of original warfare agent contamination. In an effort to neutralize small amounts of contamination over a large area, the saturation of the large area with decontamination composition may increase environmental damage to the area, increase equipment damage, or inhibit mission completion beyond that of the effects of the warfare agent itself.

Decontamination Solution 2(DS2) is a decontamination composition currently used by the United States military against a variety of warfare agents. DS2 contains 70% diethylenetriamine, 28% ethylene glycol monomethyl ether and 2% sodium hydroxide. However, DS2 is extremely corrosive, particularly in large amounts.

Other decontamination compositions have been disclosed in U.S. Pat. Nos. 5,760,089 and 5,859,064, both to Cronce. The Cronce patents disclose quaternary ammonium compound based decontamination compositions that are based on solutions of benzyltrimethylammonium chloride or benzyltriethylammonium chloride, and use a ratio of approximately 100:1 decontamination composition to chemical warfare agent. As such, the decontamination compositions are limited to in their ability to decontaminate relatively large areas of contamination.

Foam use to knock-down chemical vapors and biological particulates has been disclosed in U.S. Pat. No. 5,864,767 to Drumgoole et al. The Drumgoole patent discloses an inflatable, portable apparatus having an aqueous foam for substantially mitigating the effects of an explosively depolyable chemical, biological and/or radiological agent within the substantially defined area. Drumgoole discloses that decontamination compounds can be added to the foam to allow chemical, biological and/or radiological neutralization in situ. These decontamination compounds are limited to the relatively small areas of contamination contained within the apparatus.

In view of the foregoing, there is a need for a chemical and biological warfare agent decontamination composition useful for effective large area decontamination of the warfare agents while remaining noncorrosive, nontoxic, environmentally safe, and easy to apply. The present invention addresses this and other needs.

SUMMARY OF THE INVENTION

The present invention includes a foaming decontaminating composition for chemical and biological warfare applications, comprising a quaternary ammonium complex component, an oxidizer component and a foam component, wherein the pH ranges from about 8 or greater.

The present invention also includes a decontaminating composition produced by the process comprising the steps of providing a foaming decontaminating composition comprising a quaternary ammonium complex component, an oxidizer component and a foam component, wherein the pH ranges from about 8 or greater, agitating the foam component, wherein the quaternary ammonium complex component and oxidizer component are substantially dispersed within a foam and applying the foamed decontaminating composition onto a surface, wherein the foamed decontaminating composition contacts areas of possible contamination. With foaming of the decontaminating composition, warfare agent is contacted and becomes effectively neutralized.

The present invention further comprises a method for decontaminating a surface comprising the steps of providing a foaming decontaminating composition comprising a quaternary ammonium complex component, an oxidizer component and a foam component, wherein the pH ranges from about 8 or greater, agitating the foam component, wherein the quaternary ammonium complex component and oxidizer component are substantially dispersed within a foam and applying the foamed decontaminating composition onto a surface, wherein the foamed decontaminating composition contacts areas of possible contamination. As the decontaminating composition foams, contacted warfare agent becomes effectively neutralized.

DETAILED DESCRIPTION OF THE PREFERRED EMBODIMENT

The present invention comprises a chemical and biological warfare agent decontamination foaming composition. The foaming composition contains at least one quaternary ammonium complex (QAC), an oxidizer and a foam component. Optional incorporation of additional components are included in the foaming decontamination composition, as desired, particularly corrosion inhibitor and/or pH adjusters that maintain the pH of the foaming decontaminating composition in a range of from about 8 or greater. The foaming composition is applied by mops, brushes, fire-fighting equipment, foam generating equipment and sprayers. This foaming composition is noncorrosive, nontoxic, and nonflammable decontaminating agent, useful in rapidly neutralizing chemical and biological warfare agents, such as VX, GD and HD. The quaternary ammonium complex component and oxidizer component are solvated in solution, which is added to a foam component.

The present invention utilizes significant advantages in the application of a foam composition in the neutralization of chemical and biological contaminants. The use of foam as an applicator medium allows the neutralization chemical and biological contaminants over large areas in a safe and effective manner. The foam provides a mechanical agitation of the decontamination composition when applied in the area of the warfare agent. This increases the interaction of the decontamination composition with the warfare agent to increase effectiveness. Warfare agent is "lifted" into the foam to further increase interaction. The foam also provides a medium for the decontamination composition to reside before and during interaction with the warfare agent. This allows the use of smaller amounts of warfare agent for a given area, or volume, of contamination, increasing the safety of the using the decontamination composition. Areas of foams may be demarcated, for easy wash, rinsing, or avoidance by cleaning personnel. As well as containing the decontamination composition, the foam restrains the further spread of the warfare agent, further protecting the cleanup personnel, and other persons close-by. Additionally, versatility of the application of decontamination compositions increases with the incorporation of other components, such as fire-fighting components. By using a foaming composition, decontamination of exposed machinery, and large open areas. becomes more efficient with a significant decrease in exposure to clean-up personnel. The foaming composition creates a mechanical action to interact with the contaminant on the surface.

The QAC of the present invention comprises a general structure of:

$$N(R)(R')(R'')(R''')$$

where R, R', R", and R'" include alkyl or aryl substituents chemically bonded to the nitrogen atom, N, through a carbon atom. Preferred QACs include the chloride salts of benzyltriethylammonium and benzyltrimethylammonium, which are disclosed in U.S. Pat. Nos. 5,760,089 and 5,859,064, both to the present inventor Cronce and commonly assigned, the disclosures of which are herein incorporated by reference. Suitable amounts of QAC are used in the decontamination composition, preferably ranging from about 10% by weight or more, with more preferred amounts of QAC ranging from about 10% by weight to about 15% by weight of the decontamination composition. An individual QAC or combinations of QACs can be used within the foaming decontaminating agent, with mixtures of benzyltrimethylammonium chloride and benzyltriethylammonium chloride in ratios, such as, from about 5:1 parts to about 1:5 parts, by weight. Preferably the benzyltrimethylammonium chloride is included in mixtures having from about 2 to about 4 times the amount of benzyltriethylammonium chloride. Most preferably the decontamination composition comprises from about 8% to about 10%, by weight of benzyltrimethylammonium chloride and from about 3% to about 5%, by weight, of benzyltriethylammonium chloride. Alternatively, one of skill in the art may readily substitute other appropriate salts for the chloride salt of the QAC. Particularly preferred salts include the hydroxide salts.

The oxidizer used in combination with the QAC aids in the neutralization of the chemical and biological warfare agents. The combination of the oxidizer and QAC works particularly well to effectively neutralize organosulfur agents such as mustard gas (HD), and organophosphorus agents such as the nerve agents termed VX and GD. Hydrogen peroxide is the preferred oxidizer. Suitable oxidizers include other peroxy or hydroperoxy compounds, including, e.g., the acids and salts of peracetate, perborate monohydrate, perborate tetrahydrate, monoperoxyphthalate, peroxoymonosulfate, peroxydisulfate, and percarbonate. Other suitable oxidizers may be readily selected, by those skilled in the art in light of the disclosure herein, from among those oxidizers which are compatible with the remainder of the components present in the decontaminating composition. The amount of oxidizer is present in suitable amounts to effectively oxidize, with preferred amounts ranging from about 15% by weight or more, more preferably from about 16% by weight to about 25% by weight of the foaming decontamination agent.

The foam component comprises any suitable foam for supporting the QAC and oxidizer in a chemical or biological warfare agent application, with surfactants and stabilizers such as glycol ethers, fluorochemicals and detergents preferred. Most preferably, the foaming component comprises glycol ethers. The foaming decontaminating agent comprises any suitable amount of foam component for a specific application, with the proper amount of foam component determinable by those skilled in the art. Preferably the amount of foam component ranges from about 30% by weight or less. More preferably, the amount of foam component within the foaming decontaminating agent ranges from about 26% by weight or less, most preferably from about 16% by weight to about 25% by weight. Exemplary foaming components include AFFF manufactured by 3M of St. Paul, Minn., Knockdown manufactured by National Foam, Inc. of Exton, Pa., Silv-Ex manufactured by Ansul, Inc. of Marinette, Wis. and other similar foams.

The QAC and foaming component of the present invention are formulated in amounts of from about 2:1 (foam:QAC) or more (such as 2.5:1;3:1;3.5:1;4:1; etc.), and from about 1:2 (foam:QAC) or less (such as 1:2.5; 1:3; 1:3.5; 1:4; etc). These ratios do not create unwanted emulsions/suspensions of the foaming decontamination composition that bind the QAC and foam in a manner that inhibits the interaction of the QAC with the warfare agent. Ratios from about 2:1 to about 1:2 produce unwanted suspensions in the foam, and do not possess the advantages of a uniform dispersement of the QAC in the foam. The proper amount of QAC and foam ratios determinable by those skilled in the art for a given warfare agent situation taking into considerations such as the type of equipment available, the area to be covered, the available time of application, etc.

The foaming decontaminating composition can optionally include a corrosion inhibitor. Suitable corrosion inhibitors include amino alcohols, such as isobutanolamine, also known as 2-amino-2-methyl-1-propanol. One of skill in the art may substitute other non-toxic corrosion inhibitors, which may be selected from among primary amines, amino alcohols and polyamines. For example, when the foam is water-based, the corrosion inhibitor also may be used as a solvent, as described below. The corrosion inhibitor is incorporated in any suitable amount, as determinable by those skilled in the art in light of the disclosure herein, with preferred amounts of corrosion inhibitor ranging from about 15% by weight or more, more preferably from about 15% by weight to about 25% by weight.

In addition to the corrosion inhibitor, the decontaminating composition of the present invention may optionally contain additives such as preservatives, buffers, and reaction catalysts with the proper selection of additives determinable by those skilled in the art.

As needed, the foaming decontaminating composition comprises a pH adjustor. Suitable pH adjustors include hydrochloric acid, toluenesulfonic acid, and combinations thereof. The amount and type of pH adjustor included in the foaming decontaminating composition being determinable by those skilled in the art, with amounts ranging from about 25% by weight to about 30% by weight expected for attaining a pH of the foaming decontaminating composition ranging from about 8 or greater, with a preferred pH ranging from about 8 to about 10. Suitable acids for lowering the pH (increasing acidity) and bases for raising pH (increasing alkalinity) may be readily selected by one of skill in the art.

The decontaminating composition also may contain stabilizers which alone, or in combination with the pH adjuster, prevent reaction of the oxidizer with the other components of the formulation without inhibiting the ability of the decontaminating composition to foam and neutralize warfare agents. Stabilizers used in conjunction with a separate pH adjuster are preferably selected as to not significantly alter the pH of the decontaminating composition. Suitable stabilizers may be readily selected by one of skill in the art, taking into consideration the selected oxidizer and the other components in the decontaminating composition. For example, an acetanilide stabilizer is preferably used with a hydrogen peroxide oxidizer. Preferably, stabilizers are present in an amount of less than about 1% of the decontaminating composition.

The QAC may be optionally solvated by mixing in a suitable solvent for ease of use. The solvent presents an environmentally benign and safe composition, including non-flammable, non-corrosive, nontoxic characteristics. For incorporation into a aqueous foaming component, a solvent of water may be used. In another embodiment, the solvent comprises a diol, preferably diols capable of solvating both polar and low-polarity compounds. Diols, for example, may non-exclusively include 1,2-propanediol (propylene glycol), and other 1,2-alkanediols, particularly where the alkane is butane, pentane or hexane. The amount of solvent used varies with the intended use for incorporating the QAC into the foam, with the amount of solvent being determinable by those skilled in the art for a particular formulation use, in light of the disclosure herein.

The decontamination composition effectively decontaminates through the foaming process once applied onto a possibly contaminated surface. The foaming increases the contact of the decontamination composition with the warfare agent, suspends the warfare agent during contact, identifies the areas of decontamination, increases the mechanical agitation of the decontamination composition, allows a rinse cleanup, etc. The amount of foaming, conditions for foaming, etc., are determinable by those skilled in the art for a given situation. For example, foaming on the flight deck of an aircraft carrier may require less foaming than the runway of an airbase.

Application of the foaming decontaminating composition includes manual application by a mop, brush, or other similar manual application, and/or fire-fighting equipment, foam generating equipment or other similar sprayer applications. For example, the application of the foaming decontaminating composition includes the steps of mechanical application of the composition onto a contaminated surface, mixing, waiting for the composition to react with the contaminant and rinsing. Although mechanical agitation is provided by the foaming of the decontamination composition, additional mechanical agitation may be supplied, as desired.

Decontamination is effected by applying the decontaminating composition of the present invention to the contaminated area, material, equipment, personnel, or the like. Such application may be by any suitable means for applying a foam component onto the contaminated surface, with the type and manner of application determinable by those skilled in the art in light of the disclosure herein. Generally, such application is primarily guided by decreasing the exposure, initial or continuous, of the contaminating agent to personnel. The type of application of foaming decontamination composition to decrease exposure with any particular application means, such as spraying, showering, washing or other suitable means varies with other factors such as size of the contamination, safety equipment, etc.

The amount of decontaminating composition under field conditions can be readily determined by one of skill in the art. Preferably the decontaminating composition is used in a ratio approaching or exceeding at least about 20:1 decontaminating composition:chemical agent. Foaming amounts are determinable by those skilled in the art, with amounts of from about 0.5 inch or more preferred, and amounts of from about 1 inch to about 6 inches more preferred, and from about 1.5 inch to about 2 inches most preferred.

EXAMPLE 1

A foaming composition having 13% by weight of benzyltrimethylammonium chloride, 20% by weight of isobutanolamine, 27% by weight of toluenesulfonic acid, 20% by weight of hydrogen peroxide, and 20% by weight of Knockdown.

EXAMPLE 1A (prophet)

The foaming composition of Example 1 is sprayed onto a contaminated runway with VX agent. The sprayed decontamination composition is allowed to foam for two hours, after which it is rinsed off into collectors for disposal.

EXAMPLE 2

CHEMICAL WARFARE AGENT NEUTRALIZATION (HD)

The following results illustrate the neutralization of mustard gas (HD) using the foam-based decontaminating agent formulated as described in Example 1 above. 1.2 grams of the foaming composition of example 1 neutralizing mixture (minus oxidizer) were placed in the bottom of 13×100 mm culture tube. Immediately before use, 0.3 ml $H_2O_2$, were added. After Vortex mixing, a long stem pasteur pipette was placed in the tube, with the combined tube and pipette weighed. 23.6 microliters HD (sulfur mustard, CAS Registry No. 505-60-2) were placed in a second 13×100 mm culture tube. The neutralizer was added to the second tube using the pasteur pipette. Calculation of the added weight of the neutralizer and HD was determined by subtracting the empty neutralizer tube/pipette from the full tube/pipette, and adding the difference to the weight of the HD.

The weight of the HD was: 0.0236×1.27=0.029972 grams=29972 micrograms.

The tube was vortex mixed immediately after adding neutralizer to the HD. Aliquots were removed at 5, 10, 20, 30 and 60 minutes. The aliquots were placed into a quench solution containing 1.0 ml chloroform. The tubes were immediately vortex mixed and centrifuged, then the chloroform layer was removed and analyzed for residual HD.

The quench tube containing chloroform was weighed before and after adding aliquot to obtain weight of aliquot.

Neutralizer=1.34 grams

HD=0.03 grams total Weight=1.37 grams

Maximum HD=29972 μg/1.37 grams=21899 μg/gram

| Time (min.) | Aliquot Weight (grams) | Maximum HD (μg) | HD Measured* (μg) | % neutralized |
|---|---|---|---|---|
| 5 | 0.20 | 4375 | 117 | 97.33 |
| 10 | 0.15 | 3282 | 3 | 89.91 |
| 20 | 0.15 | 3282 | 4 | 99.88 |
| 30 | 0.13 | 2844 | 6 | 99.79 |
| 60 | 0.16 | 3500 | 7 | 99.80 |

*Some HD appeared to have been absorbed to the foam above the solution and was sampled as the foam subsided in the course of the test.

EXAMPLE 3

CHEMICAL WARFARE AGENT NEUTRALIZATION (GD & VX)

0.2 ml $H_2O_2$ were added to 0.8 grams neutralizer (minus oxidizer) in a tube immediately before use, and vortex mixed. A long-stem pasteur pipette was placed in the tube. The tube and pipette were weighed. The contents of the tube were transferred to the 13×100 mm culture tube that contained 20 microliters of GD or VX.

GD=20,000×1.02=20,400

VX=20,000×1.01=20,200

For calculation, 0.02 grams were used for both GD and VX. Vortex mixing occurred and the empty neutralizer tube and pipette were weighed. Aliquots were removed after five (5), ten (10), fifteen (15), twenty (20), and thirty (30) minutes for both GD; and five (5), ten (10), twenty (20), thirty (30), and sixty (60) minutes for VX.

GD Neutralization:

Neutralizer=0.91 grams

GD=0.02 grams

Maximum GD=20400 μg/0.93 grams=21935 μg/gram

| Time (min.) | Aliquot Weight (grams) | Maximum GD (μg) | GD Measured* (μg) | % neutralized |
|---|---|---|---|---|
| 5 | 0.09 | 1974 | 902.82 | 59.26 |
| 10 | 0.08 | 1755 | 735.02 | 58.12 |
| 15 | 0.08 | 1755 | 546.68 | 68.85 |
| 20 | 0.09 | 1974 | 425.00 | 78.47 |
| 30 | 0.09 | 1974 | 413.60 | 79.05 |

VX Neutralization:

Neutralizer=0.91 grams

VX=0.02 grams

Maximum VX=20200 μg/0.93 grams=21720 μg/gram

| Time (min.) | Aliquot Weight (grams) | Maximum VX (μg) | VX Measured* (μg) | % neutralized |
|---|---|---|---|---|
| 5 | 0.09 | 1955 | 1799 | 7.98 |
| 10 | 0.09 | 1955 | 1735 | 11.30 |
| 20 | 0.09 | 1955 | 1662 | 14.99 |
| 30 | 0.08 | 1738 | 1390 | 30.02 |
| 60 | 0.09 | 1955 | 1276 | 34.73 |

EXAMPLE 4

CHEMICAL WARFARE AGENT NEUTRALIZATION

The following results illustrate the neutralization of chemical warfare agents using the foam-based decontaminating agent formulated as described in Example 1 above, except using 20% by weight Silv-Ex instead of Knockdown. The procedures for HD, GD and VX are the same as those detailed in Examples 2 and 3.

HD Neutralization:

Neutralizer added to 0.04 grams HD=1.93 grams

Total Weight=1.97 grams

HD=40,000 micrograms/1.97 grams=20,305 micrograms/gram

| Time (min.) | Aliquot Weights (grams) | HD Measured* (μg) | % neutralized |
|---|---|---|---|
| 5 | 0.18 | 20206 | 8.06 |
| 10 | 0.17 | 18706 | 14.89 |
| 20 | 0.14 | 13793 | 37.24 |
| 30 | 0.14 | 10521 | 52.13 |
| 60 | 0.16 | 8338 | 62.06 |

GD Neutralization:

Neutralizer added to 0.015 grams of GD=0.63 grams

Total Weight=0.645 grams

GD=15,300 micrograms.0.645 grams 23721 μg/gram

| Time (min.) | Aliquot Weights (grams) | GD Measured* (μg) | % neutralized |
|---|---|---|---|
| 5 | 0.08 | 0.18 | 99.9992 |
| 10 | 0.08 | ND | >99.9996 |
| 20 | 0.08 | ND | >99.9996 |
| 30 | 0.08 | ND | >99.9996 |
| 60 | 0.08 | ND | >99.9996 |

ND=<0.09 micrograms/gram

VX Neutralization:

Neutralizer added to 0.015 grams of VX=0.63 grams

Total Weight=0.645 grams

VX=15,750 micrograms/0.645 grams=23488 μg/gram

| Time (min.) | Aliquot Weights (grams) | VX Measured* (#g) | % neutralized |
|---|---|---|---|
| 5 | 0.08 | 4709.00 | 79.95 |
| 10 | 0.09 | 1172.56 | 95.00 |
| 20 | 0.08 | 290.25 | 98.76 |
| 30 | 0.09 | 67.00 | 99.71 |
| 60 | 0.09 | 4.25 | 99.98 |

EXAMPLE 5

CHEMICAL WARFARE AGENT NEUTRALIZATION

The following results illustrate the neutralization of chemical warfare agents using the foam-based decontaminating agent formulated as described in Example 1 above, except using 20% by weight AFFF instead of Knockdown. The procedures for HD, GD and VX are the same as those used for Examples 2 and 3.

HD Neutralization:

Neutralizer added to 0.04 grams of HD=1.80 grams

Total Weight=1.84 grams

HD=40,000 μg/1.84 grams=21739 micrograms/gram

| Time (min.) | Aliquot Weights (grams) | HD Measured* (μg) | % neutralized |
|---|---|---|---|
| 5 | 0.08 | 15646 | 28.03 |
| 10 | 0.13 | 12887 | 40.72 |
| 20 | 0.14 | 8891 | 59.10 |
| 30 | 0.12 | 6151 | 71.71 |
| 60 | 0.16 | 2412 | 88.90 |

GD Neutralization:

Neutralizer added to 0.015 grams of GD=0.62 grams

Total Weight=0.635 grams

GD=15,300 micrograms 0.645 grams=24094 μg/gram

| Time (min.) | Aliquot Weights (grams) | GD Measured* (μg) | % neutralized |
|---|---|---|---|
| 5 | 0.10 | 0.099 | 99.9996 |
| 10 | 0.10 | ND | >99.9996 |
| 20 | 0.10 | ND | >99.9996 |
| 30 | 0.09 | ND | >99.9996 |
| 60 | 0.08 | ND | >99.9996 |

ND=<0.09 micrograms/gram

VX Neutralization:

Neutralizer added to 0.015 grams of VX=0.65 grams

Total Weight=0.665 grams

VX=15,750 micrograms/0.665 grams=22782 μg/gram

| Time (min.) | Aliquot Weights (grams) | VX Measured* (μg) | % neutralized |
|---|---|---|---|
| 5 | 0.10 | 417.88 | 98.1657 |
| 10 | 0.08 | 150.75 | 99.3383 |
| 20 | 0.08 | 6.87 | 99.9702 |

-continued

| Time (min.) | Aliquot Weights (grams) | VX Measured* (μg) | % neutralized |
|---|---|---|---|
| 30 | 0.08 | 2.88 | 99.9874 |
| 60 | 0.08 | ND | >99.9389 |

ND=<0.25 micrograms/gram

EXAMPLE 6

EFFECTIVE RATIO OF QAC AND FOAM COMPONENT

Various QAC and foam component ratios were formulated, with the results showing that ratio of QAC foam component of between 2:1 and 1:2 generally formed unacceptable suspensions.

| Ratio | Knockdown | Silv-EX | AFFF | Forexpan |
|---|---|---|---|---|
| 1:10 | no suspension | no suspension | no suspension | no suspension |
| 1:5 | no suspension | no suspension | no suspension | no suspension |
| 1:2 | semi-suspension | semi-suspension | suspension | suspension |
| 1:1 | suspension | suspension | suspension | suspension |
| 2:1 | suspension | suspension | suspension | suspension |
| 5:1 | no suspension | no suspension | no suspension | suspension |
| 10:1 | no suspension | no suspension | no suspension (assumed) | suspension |

The foregoing summary, description, and examples of the present invention are not intended to be limiting, but are only exemplary of the inventive features which are defined in the claims.

What is claimed is:

1. A foaming decontaminating composition for a chemical and biological warfare agent, comprising a quaternary ammonium complex component;

an oxidizer component;

a foam generating component other than a quaternary ammonium complex; and, isobutanolamine as a corrosion inhibitor;

wherein the foam generating component supports the quaternary ammonium complex and oxidizer effective for decontamination of the warfare agent; and wherein the pH ranges from about 8 or greater.

2. The foaming decontamination composition of claim 1, further comprising a solvent.

3. The foaming decontamination composition of claim 1, wherein the quaternary ammonium complex and foam generating component having a ratio of from about 2:1 quaternary ammonium complex to foam component or more.

4. The foaming decontamination composition of claim 1, wherein the quaternary ammonium complex and foam generating component having a ratio of from about 1:2 quaternary ammonium complex to foam component or less.

5. The foaming decontaminating composition of claim 1, wherein the quaternary ammonium complex component comprises an benzyl compound selected from the group consisting of benzyltrimethylammonium chloride, benzyltriethylammonium chloride and combinations thereof.

6. The foaming decontaminating composition of claim 1, wherein the quaternary ammonium complex component is present in an amount of from about 10 weight percent or more.

7. The foaming decontaminating composition of claim 6, wherein the quaternary ammonium complex component is present in an amount of from about 10 weight percent to about 15 weight percent.

8. The foaming decontaminating composition of claim 1, wherein the oxidizer is selected from the group consisting of the acids or salts of peracetate, perborate monohydrate, perborate tetrahydrate, monoperoxyphthalate, peroxymonosulfate, peroxydisulfate, percarbonate and hydrogen peroxide.

9. The foaming decontaminating composition of claim 8, wherein the oxidizer comprises hydrogen peroxide.

10. The foaming decontaminating composition of claim 1, wherein the oxidizer is present in an amount of from about 15 weight percent or more.

11. The foaming decontaminating composition of claim 10, wherein the oxidizer is present in an amount of from about 16 weight percent to about 25 weight percent.

12. The foaming decontaminating composition of claim 1, wherein the foam generating component is present in an amount of from about 15 weight percent or more.

13. The foaming decontaminating composition of claim 12, wherein the foam generating component is present in an amount of from about 16 weight percent to about 25 weight percent.

14. The foaming decontaminating composition of claim 1, further comprising a pH adjustor selected from the group consisting of hydrochloric acid, toluenesulfonic acid, and combinations thereof.

15. The foaming decontaminating composition of claim 14, wherein the pH adjustor is present in an amount of from about 25 weight percent to about 30 weight percent.

16. The foaming decontaminating composition of claim 15, wherein the isobutanolamine is present in an amount of from about 15 weight percent or more.

17. A decontaminating composition produced by the process comprising the steps of:

providing a foaming decontaminating composition comprising a quaternary ammonium complex component, an oxidizer component, a foam generating component other than a quaternary ammonium complex, and isobutanolamine as a corrosion inhibitor, wherein the pH ranges from about 8 or greater; and agitating the foam generating component, wherein the quaternary ammonium complex component and oxidizer component are substantially dispersed within the resulting foam.

18. A method for decontaminating a surface, comprising the steps of:

providing a foaming decontaminating composition comprising a quaternary ammonium complex component, an oxidizer component, a foam generating component other than a quaternary ammonium complex, and isobutanolamine as a corrosion inhibitor, wherein the pH ranges from about 8 or greater;

agitating the foam generating component, wherein the quaternary ammonium complex component and oxidizer component are substantially dispersed within the resulting foam, and, applying the foamed decontaminating composition onto a surface, wherein the foamed decontaminating composition contacts areas of possible warfare agent contamination.

* * * * *